United States Patent [19]

Gagnon et al.

[11] Patent Number: 4,529,071

[45] Date of Patent: Jul. 16, 1985

[54] RATCHETING TOOL WITH IMPROVED CAM SHIFTER MEANS

[75] Inventors: Richard Gagnon, W. Springfield; Stanley Orszulak, Springfield, both of Mass.; Louis Pawloski, Rock Hill, S.C.; Michael L. Bodnar, Gastonia, N.C.

[73] Assignee: Easco Hand Tools, Inc., Lancaster, Pa.

[21] Appl. No.: 395,810

[22] Filed: Jul. 6, 1982

[51] Int. Cl.[3] ..... B25B 13/46

[52] U.S. Cl. ..... 192/43.1; 81/62; 81/33

[58] Field of Search ..... 192/43.1; 81/62; 145/72, 75, 76; 464/37

[56] References Cited

U.S. PATENT DOCUMENTS

| | | | |
|---|---|---|---|
| 275,235 | 3/1883 | Mallett et al. | 145/75 |
| 277,561 | 5/1883 | Furbish | 145/75 |
| 291,007 | 12/1883 | Thayer | 145/75 |
| 662,512 | 1/1901 | Furbish | 145/75 |
| 882,539 | 3/1908 | Schade | 192/43.1 X |
| 895,713 | 8/1908 | Anderson | 192/43.1 X |
| 1,193,716 | 8/1916 | Purssell | 145/75 |
| 1,493,353 | 5/1924 | Leopold | 145/75 |
| 1,562,862 | 11/1925 | Bodmer | 145/75 |
| 2,003,346 | 6/1935 | Dodge | 81/62 |
| 2,020,883 | 11/1935 | Gagne | 192/43.1 |
| 2,107,568 | 2/1938 | Haist | 192/43.1 X |
| 2,110,099 | 3/1938 | Thewes | 192/43.1 X |
| 2,201,492 | 5/1940 | Jagler | 81/62 X |
| 2,404,092 | 7/1946 | Reynolds | 81/62 X |
| 2,407,558 | 9/1946 | Kress | 81/62 X |
| 2,544,795 | 3/1951 | Knudsen | 192/43.1 |
| 2,565,961 | 8/1951 | Godfrey | 192/43 |
| 2,720,296 | 10/1955 | Briglia | 192/43.1 |
| 2,989,881 | 6/1961 | Lavietes | 145/75 X |
| 3,222,943 | 12/1965 | McDonald | 192/43.2 X |
| 3,256,966 | 6/1966 | Angquist | 192/43.1 X |
| 3,436,992 | 4/1969 | Over et al. . | |
| 3,554,251 | 1/1971 | McLogan | 145/75 |
| 4,137,801 | 2/1979 | Imperid | 81/62 X |
| 4,341,292 | 7/1982 | Acevedo | 145/76 X |

FOREIGN PATENT DOCUMENTS

| | | | |
|---|---|---|---|
| 4271 | of 1886 | United Kingdom | 145/76 |

*Primary Examiner*—Rodney H. Bonck
*Assistant Examiner*—David D. House
*Attorney, Agent, or Firm*—Leonard Bloom

[57] ABSTRACT

A ratcheting tool has a handle mounted on a ratchet housing. The ratchet housing has a blind axial bore formed therein. A driven shank has a rearward portion nested partially in the bore, and a ratchet is formed externally on the rearward portion of the shank. A cam is seated in the bore, rearwardly of the ratchet, and is pivotable substantially about the axis of the bore. The cam has a bore formed therein, and a thrust ball is seated in the cam bore axially between the bottom of the blind axial bore in the ratchet housing and the rearward portion of the shank, thereby accommodating axial thrust loads on the tool. A selector pin is carried by the cam and extends radially therefrom through an arcuate slot in the ratchet housing. A pair of L-shaped pawls are alternately actuated by the cam. The pawls have respective leg portions extending forwardly to engage the ratchet, thereby alternately keying the ratchet to the ratchet housing. The cam has a three-position detented connection with the ratchet housing, thereby establishing clockwise and counterclockwise ratchet drive positions and an intermediate locked position, respectively. A knurled spinner is rotatably piloted on the ratchet housing for optional manual use, and the spinner is suitably keyed to a intermediate portion of the shank.

15 Claims, 13 Drawing Figures

RATCHETING TOOL WITH IMPROVED CAM SHIFTER MEANS

FIELD OF THE INVENTION

The present invention relates to a ratcheting tool, and more particularly, to a hand-held ratcheting tool for use as a wrench, screwdriver or the like.

BACKGROUND OF THE INVENTION

Ratcheting wrenches, screwdrivers and similar tools have been very highly developed in the prior art. These tools usually have a ratchet housing rotatably driven by a handle or other suitable means, and a driven shank or other member is nested partially within the ratchet housing. A cooperating ratchet drive, either external or internal, is formed between the housing and the shank. Respective spring-loaded pawls are arranged to alternately key the ratchet housing to the shank, thereby facilitating either a forward (clockwise) or reverse (counterclockwise) drive of the shank. A reversing button or lever is provided to shift the pawls for reversing the drive direction.

The prior art has also disclosed a knurled spinner mounted on the shank forwardly of the handle for engagement by the operator's fingers. The spinner facilitates a rapid run-down of a fastener (or other element) driven by the tool, after which the handle may be used for final torquing of the fastener. In the reverse drive position, and once the fastener has been unseated, the spinner may be used for rapid removal of the fastener.

Although many of these prior art designs are entirely satisfactory for the purposes intended, there are certain inherent disadvantages or deficiencies which may be alleviated by further improvements. Moreover, while the market is both mature and sophisticated, nevertheless, it will be appreciated that new features, convenience of operation, reliability, and economy of manufacture are paramount objectives. These objectives pertain not only to the professional tradesmen or mechanics, but also to the do-it-yourselfers in the rapidly expanding consumer hardware market.

SUMMARY OF THE PRESENT INVENTION

Accordingly, it is an object of the present invention to alleviate the disadvantages and deficiencies of the prior art by providing an improved ratcheting tool.

It is another object of the present invention to provide a ratcheting tool which is reliable and is convenient to operate, yet is economical to manufacture.

It is yet another object of the present invention to provide a ratcheting tool which has an improved spinner for facilitating a rapid run-down (or removal) of a nut or other fastener.

It is a further object of the present invention to provide an improved ratchet mechanism for use either in an integral tool or in a removable adapter.

In accordance with the teachings of the present invention, a ratchet housing is mounted on a handle means for conjoint turning movement therewith. Preferably, the ratchet housing and handle means are substantially alined axially of one another, and the handle means is adapted for convenient use by the operator. The ratchet housing has an axial bore formed therein, and a driven shank has a rearward portion nested partially within the bore. An external ratchet is formed on the rearward portion of the shank. A cam is seated within the bore, rearwardly of the ratchet, for pivotable movement about the axis of the bore. When the cam is pivoted, it actuates respective pawls. These pawls have respective forwardly-extending portions which alternately cooperate with the ratchet for keying the ratchet housing to the shank and determining the drive direction. A selector means is carried by the cam and extends radially therefrom for pivoting the cam and reversing the pawls, and an arcuate slot is formed in the ratchet housing to accommodate movement of the selector means.

These and other objects of the present invention will become apparent from a reading of the following specification, taken in conjunction with the enclosed drawings.

DESCRIPTION OF THE PREFERRED EMBODIMENT

Figure 1:
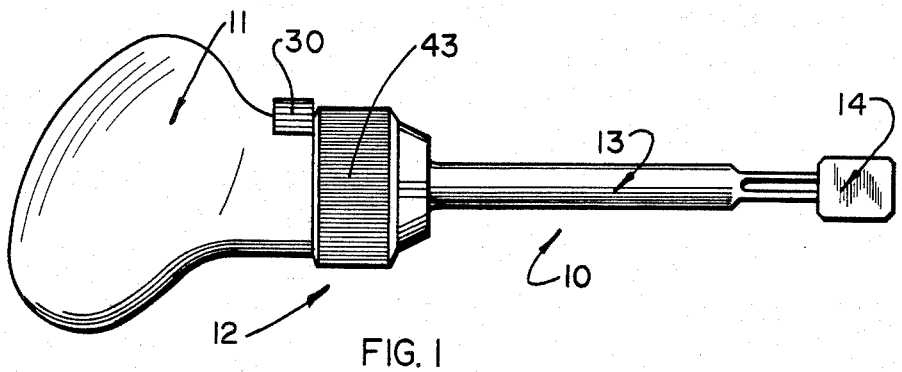
FIG. 1 is a side elevation of one embodiment of the present invention.
Figure 2:
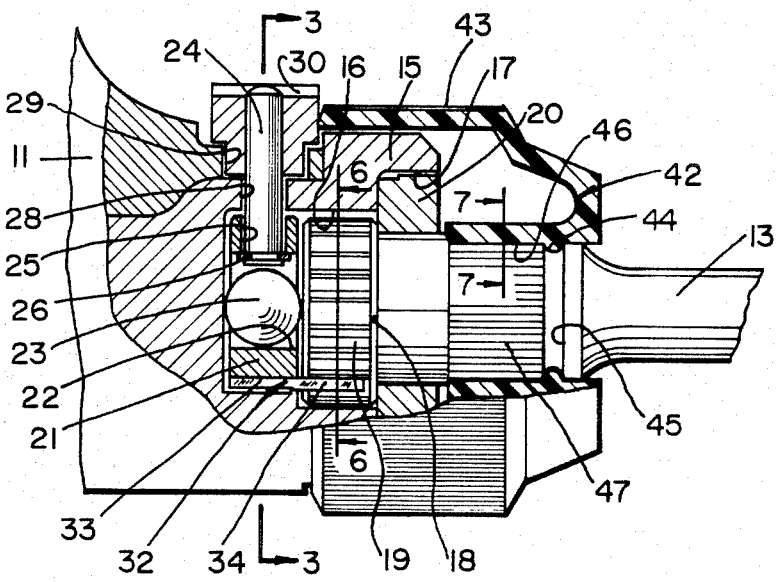
FIG. 2 is an enlarged portion of FIG. 1, with parts broken away and sectioned to show the ratchet mechanism.

With reference to FIG. 1, there is illustrated a hand-operated wrench 10 with which the teachings of the present invention may find more particular utility. However, it will be appreciated by those skilled in the art that the teachings of the present invention are not necessarily restricted thereto, but rather, are equally applicable to a wide variety of wrenches, screwdrivers or similar fastener-type tools, as well as to a variety of driving means. With this in mind, the wrench 10 generally comprises a handle 11, a ratchet mechanism 12 between the handle and an elongated shank 13, and a two-position adapter 14 (or other socket or implement) carried on the end of the shank.

While any type of suitable handle may be employed, the non-symmetrical handle 11 (which is somewhat "egg-shaped") has been found to be quite desirable. This handle is specially adapted for the average operator's hand grip so as to reduce fatigue and improve comfort over extended usage of the tool. However, the particular details of the handle form no part of the present invention, and are described and claimed in a copending application Ser. No. 402,763, filed July 28, 1982, and assigned to the assignee of the present invention.

With reference to FIGS. 2–7, the handle is suitably secured to a ratchet housing 15 for conjoint turning movement therewith. The ratchet housing, which preferably is disposed axially forwardly of the handle, has a blind axial bore 16 and a communicating counterbore 17 formed therein. The shank has an enlarged rearward portion 18 telescoped or nested partially within the bore. A ratchet 19 is formed externally on the enlarged rearward portion of the shank. A collar 20 is press-fitted within the communicating counterbore, forwardly of the ratchet, thereby retaining the shank within the ratchet housing.

A rotatable disc-like cam 21 is seated within the bottom of the bore, rearwardly of the ratchet, and is pivotable about the axis of the bore. The cam has a cam bore 22 and a thrust ball 23 is seated therein, axially between the bottom of the bore in the ratchet housing and the rear portion of the shank, thereby accommodating axial thrust loads on the tool. A selector pin 24 is carried by the cam radially of the bore therein. The pin projects through a radial bore 25 in the cam and is retained by a ring 26 seated in an external annular groove 27 formed on the pin. The pin extends radially of the cam and through communicating arcuate slots 28 and 29 formed in radially-adjacent portions of the ratchet housing and handle, respectively, thereby accommodating circumferential movement of the pin and pivoting the cam accordingly. A knurled selector button 30 is carried on the outer end of the pin.

Figure 5:
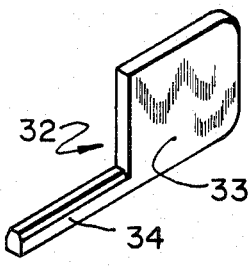
FIG. 5 is an isometric view of one of the L-shaped pawls.
Figure 6:
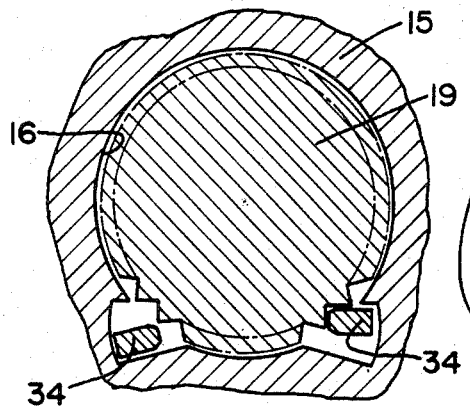
FIG. 6 is a section view, taken along the lines 6—6 of FIG. 2, showing the ratchet on the shank nested within the bore in the ratchet housing, and further showing the cooperation between the ratchet and a pair of pawls.

With reference again to FIGS. 2–4, and with further reference to FIGS. 5 and 6, the cam has a pair of truncated or chordal faces 31A and 31B which respectively engage a pair of L-shaped pawls 32. Each of the pawls 32, as shown more clearly in FIG. 5, has a base portion 33 and a leg portion 34. The base portions 33 of the pawls are alternately engaged by the faces 31A, 31B of the cam, and the leg portions 34 of the pawls project axially forwardly therefrom to alternately cooperate with the ratchet on the shank, thereby keying the ratchet housing to the shank and determining the drive direction. The ratchet housing has internal recesses 35 and 36 formed therein, radially of the base portions of the pawls, for sequentially receiving one or the other pawl. A flat spring 37 is disposed between the recesses and the pawls for biasing the pawls against the cam. The cam also carries a detent ball 38 loaded by a spring 39 received in a radial pocket 40 in the cam. The ball is adapted to be received in one of three internal pockets 41 formed within the ratchet housing. Thus, the rotatable cam has a three-position detented connection with the ratchet housing.

Figure 3:
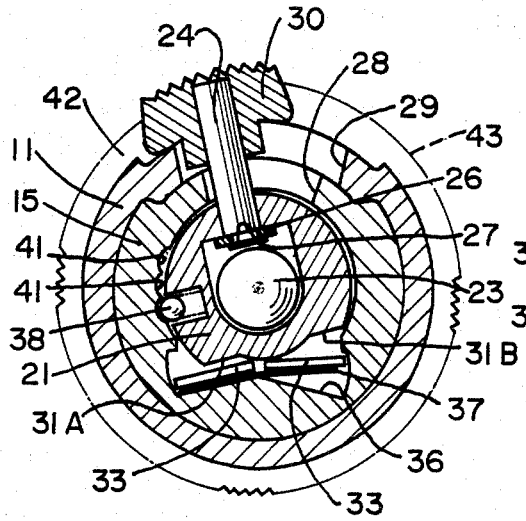
FIG. 3 is a section view, taken along the lines 3—3 of FIG. 2, and showing the means for shifting the ratchet mechanism from "forward" to "reverse" drive and vice-versa.
Figure 4:
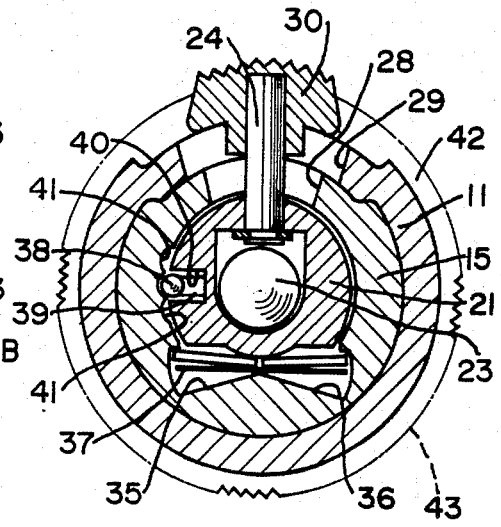
FIG. 4 corresponds to FIG. 3, but shows the ratchet mechanism in its intermediate position, wherein the shank is locked to the ratchet housing.

In FIG. 4, the cam and pawls are shown in an intermediate position. In this position, the ratchet housing and hence the handle are locked solidly to the shank; the shank may be rotated in either a clockwise or a counter-clockwise direction, and in this mode no ratcheting is available. The other two positions of the cam and pawls represent the respective "forward" (clockwise) and "reverse" (counterclockwise) ratchet drive positions, one of which is shown in FIG. 3.

Figure 7:
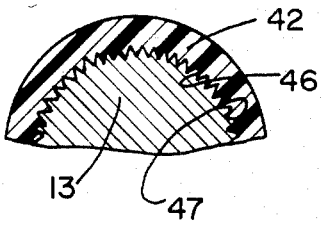
FIG. 7 is a section view, taken along the lines 7—7 of FIG. 2, showing a preferred splined connection between the driven shank and a free-wheeling knurled spinner.

With reference again to FIG. 2, and with further reference to FIG. 7, a cup-shaped spinner member 42 has an outer cylindrical portion rotatably piloted on the ratchet housing and provided with external knurls 43 to facilitate a convenient manipulation. The spinner further has an internal cylindrical portion provided with a protruding annular bead 44 seated in an external annular groove 45 on the shank, thereby retaining the spinner against axial displacement. The spinner, which is preferably molded from a suitable plastic material, has an internal cylindrical portion 46 which is pressed over a splined intermediate portion 47 of the shank. The softer plastic material takes the "memory" of the shank splines, thereby keying the spinner to the shank for rotation in unison. The spinner may be manipulated conveniently between the operator's thumb and forefinger for rapid run-down of the nut (or other fastener element) in the forward position of the ratchet mechanism without requiring a repeated pivotable movement of the handle through the operator's wrist action. Thereafter, the handle may be turned to torque the nut into final engagement. The reverse operation would be employed for nut removal.

Thus it will be appreciated by those skilled in the art that an improved ratchet tool has been provided, one which is compact, and economical to manufacture, yet has the desirable features of ease of operation and optional rapid run-down.

Figure 8:
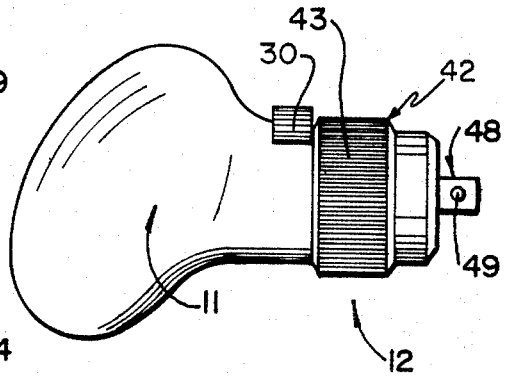
FIG. 8 is an alternate embodiment of the present invention, corresponding substantially to the FIG. 1 embodiment, but having a shortened output shank.
Figure 9:
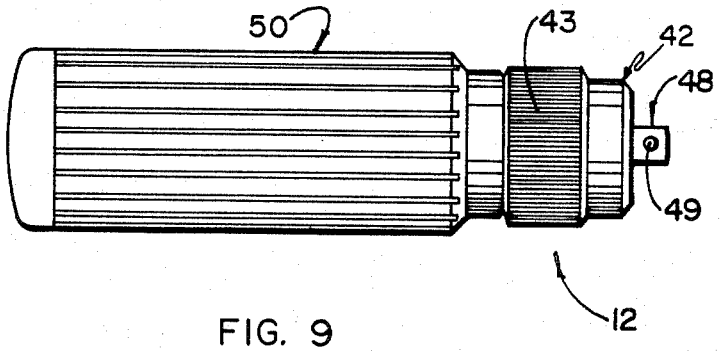
FIG. 9 is a further embodiment, corresponding to FIG. 8, but showing a conventional cylindrical handle substituted for the non-symmetrical handle.
Figure 10:
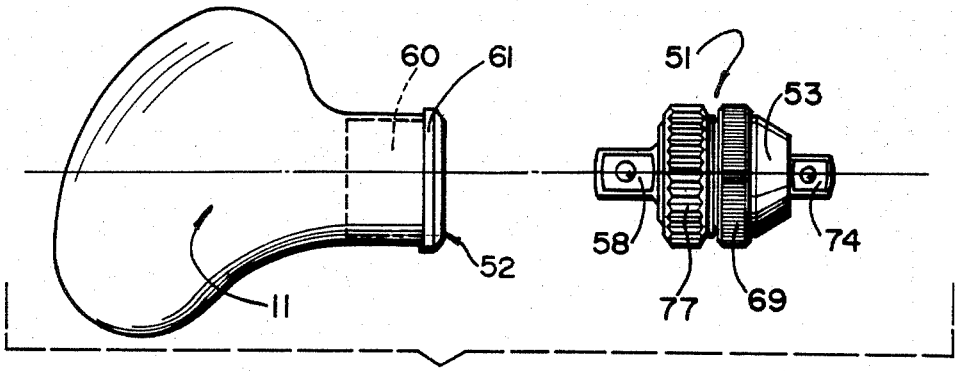
FIG. 10 is an exploded elevation of a further embodiment, wherein the ratchet mechanism comprises a separate ratchet adapter, and wherein the ratchet adapter is removably mounted to the handle by an adapter insert.
Figure 11:
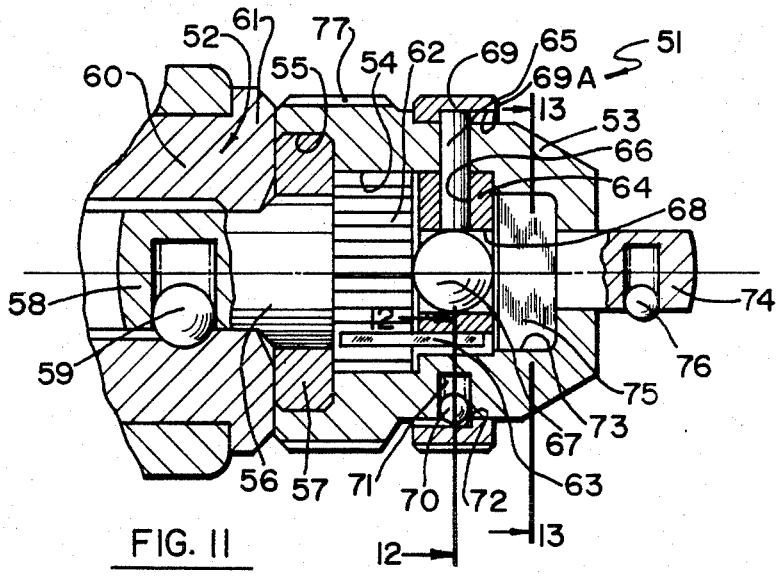
FIG. 11 shows the embodiment of FIG. 10 in its assembled relationship, with certain parts being broken away and sectioned.
Figure 12:
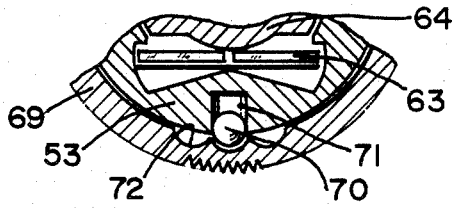
FIG. 12 is a section view, taken along the lines 12—12 of FIG. 11, and showing the means for shifting the pawls to reverse the drive.
Figure 13:
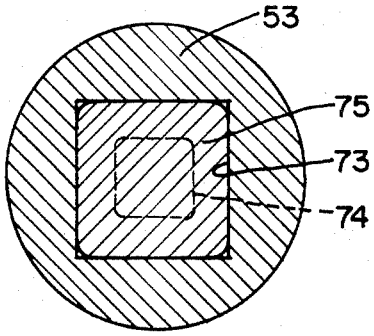
FIG. 13 is a section view, taken along the lines 13—13 of FIG. 11, and showing a keyed connection between the ratchet housing and the output shank.

In FIG. 8, the handle 11 has been secured to an alternate embodiment of the ratchet mechanism, one having a shortened output shank 48. The shank 48 has a conventional spring-loaded ball detent 49 for directly receiving the usual sockets (or other implements) which, being conventional, have been omitted for ease of illustration. Moreover, in FIG. 9, the ratchet mechanism has been secured to a more conventional elongated handle 50, one having a series of longitudinal serrations about its cylindrical periphery.

With reference to FIGS. 10–13, a further alternate embodiment is illustrated. Here, a separate ratchet adapter 51 is employed. This ratchet adapter is removably coupled to the handle 11 by an insert adapter 52 in the handle. Like the ratchet mechanism of the FIG. 1 embodiment, the ratchet adapter 51 has a ratchet housing 53 provided with a bore 54 and a communicating counterbore 55. An input shank 56 is received in the bore and is retained by a collar 57 press-fitted in the counterbore. The input shank has a square cross-sectioned portion or tang 58 provided with a spring-loaded detent ball 59 for removably coupling the ratchet adapter 51 to the insert adapter 52. The insert adapter has a cylindrical body 60 and an annular flange 61 and is integrally molded within the handle.

The input shank has an external ratchet 62 formed thereon for cooperation with L-shaped pawls 63. These pawls, like the pawls of the FIG. 1 embodiment, are actuated by a cam member 64. The cam is seated in the bore in the ratchet housing, axially of the ratchet, and is pivotable substantially about the axis of the bore. A plurality of circumferentially-spaced pins (one of which is shown at 65 in FIG. 11) are received in respective radial pockets 66 formed in the cam, and a ball 67 is retained in a communicating bore 68 in the cam. The ball 67 has a dual function: first, to lock the radially-projecting pins 65 in position; and second, to provide a stop and back-up for the input drive shank 56. The ball 67 has point tangent contact and reduces friction of the rotatable input drive shank. The outer ends of the pins project beyond the ratchet housing 53 and are received in a blind annular groove 69A in a knurled shift ring 69, thereby retaining the shift ring on the ratchet housing. This shift ring 69 has a three-position detented connection with the ratchet housing, thereby providing clockwise ("forward"), counterclockwise ("reverse") and intermediate locked positions, respectively. This detented connection preferably comprises a ball 70, spring 71, and three pockets 72 formed internally in the shift ring. A squared (or other polygonal) recess 73 is formed in the ratchet housing forwardly of the cam; and a shortened output shank 74 has a squared section 75 mounted in the recess, thereby keying the ratchet housing to the output shank. The output shank also carries a conventional ball detent 76. Moreover, the ratchet housing is radially enlarged and knurled (as at 77) to facilitate its manual manipulation, as desired, in the same manner as the spinner 42 (shown in FIG. 2). The operation of this alternate FIG. 11 embodiment of the present invention is thus similar to the operation of the preferred embodiment of FIG. 2 (as previously described). However, in FIG. 11, the ratchet drive is from the handle 11 to its integral insert adapter 52, to the tang 58 on the input drive shank 56, to the ratchet 62 formed integrally on the shank 56, to one of the pawls 64, to the ratchet housing 53, and to the squared section 75 on the output shank 74.

Thus it will be appreciated that the teachings of the present invention facilitate the commercial marketing of a line of related ratcheting tools and adapters, wherein standard components may be used interchangeably for improved manufacturing efficiency.

Obviously, many modifications may be made without departing from the basic spirit of the present invention. Accordingly, it will be appreciated by those skilled in the art that within the scope of the appended claims, the invention may be practiced other than has been specifically described herein.

I claim:

1. A ratcheting tool, comprising a driving handle, a substantially cylindrical ratchet housing secured to the handle and extending forwardly therefrom, the ratchet housing having a blind axial bore formed therein, a driven shank having a rearward portion nested partially in the blind axial bore, a ratchet formed externally on the rearward portion of the shank, a cam seated in the bottom of the blind axial bore rearwardly of the ratchet and pivotable about the axis of the bore, a selector pin carried by the cam and extending radially therefrom, the ratchet housing having an arcuate slot formed therein to accommodate movement of the pin, a pair of substantially L-shaped pawls having respective base portions alternately engaged by the cam, the pawls further having respective leg portions extending forwardly of the cam and alternately engaging the ratchet, thereby establishing ratchet drive of the shank in either a clockwise or counterclockwise direction, a knurled spinner piloted on the ratchet housing, and means keying the spinner to an intermediate portion of the shank fowardly of the ratchet.

2. The ratchet tool of claim 1, wherein the cam comprises a substantially cylindrical member having truncated faces bearing against the respective base portions of the pawls, and wherein the ratchet housing has a pair of internal recesses formed therein, one for each of the base portions of the pawls, whereby a respective pawl may be received in its recess as said pawl is selectively disengaged from the ratchet.

3. The ratcheting tool of claim 2, further including resilient means between the respective pawls and recesses.

4. The ratcheting tool of claim 1, wherein the cam has a bore formed therein, and wherein a thrust ball is seated in the cam bore axially between the bottom of the bore in the ratchet housing and the rearward portion of the shank, thereby accommodating axial thrust loads on the tool.

5. The ratcheting tool of claim 1, further including a selector button carried by the selector pin radially of the ratchet housing.

6. The ratcheting tool of claim 1, further including three-position detent means between the cam and the ratchet housing, thereby establishing clockwise and counterclockwise ratchet drive positions and an intermediate locked position.

7. The ratcheting tool of claim 1, wherein the ratchet is formed on an enlarged rearward portion of the shank, wherein the ratchet has a counterbore formed therein, and wherein a retaining collar is secured within the counterbore and forwardly of the enlarged rearward portion of the shank, thereby retaining the shank within the ratchet housing.

8. A ratcheting tool, comprising a driving handle means, a ratchet housing mounted on the handle means for turning movement therewith, the ratchet housing and handle means being substantially alined axially of one another, the ratchet housing having a blind axial bore formed therein, a shank having a portion nested partially within the bore, a ratchet formed externally on the nested portion of the shank, a cam comprising a rotatable disc seated in the blind axial bore axially and rearwardly of the ratchet and directly adjacent thereto, wherein the disc cam is wholly confined radially within the bore and is trapped axially between the bottom of the blind axial bore and the ratchet on the shank, the cam being pivotable about the axis of the bore, a pair of pawls actuated by respective truncated chordal faces on the disc cam and extending axially therefrom for alternately keying the ratchet housing to the ratchet on the shank and determining its drive direction, wherein the pawls are maintained in engagement with the ratchet without the necessity of a resilient bias being exerted on the disc cam, selector means carried by the cam and extending radially therefrom, whereby the cam may be pivoted within the radial confines of the blind axial bore for reversing the pawls, and the ratchet housing having an arcuate slot formed therein for accommodating movement of the selector means.

9. A ratcheting tool, comprising a substantially cylindrical ratchet housing having a blind axial bore formed therein, means for rotatably driving the ratchet housing, a driven shank having a rearward portion nested partially in the bore in the ratchet housing, ratchet means formed externally on the rearward portion of the shank, a cam comprising a rotatable disc seated in the bottom of the blind axial bore rearwardly of the ratchet means and directly adjacent thereto, wherein the disc cam is wholly confined radially within the bore and is trapped axially between the bottom of the blind axial bore and the ratchet means on the shank, the cam being pivotable about the axis of the bore, a selector pin carried by the cam and extending radially therefrom, the ratchet housing having an arcuate slot formed therein to accommodate movement of the pin, and reversible pawl means actuated by truncated chordal faces on the disc cam and engaging the ratchet means, wherein the pawl means are maintained in engagement with the ratchet means without the necessity of a resilient bias being exerted on the disc cam.

10. A ratcheting tool, comprising a ratchet housing having a blind axial bore formed therein, means for rotatably driving the ratchet housing, a driven shank having a rearward portion nested partially in the bore in the ratchet housing, ratchet means on the rearward portion of the shank, a cam seated in the blind axial bore axially and rearwardly of the ratchet means and pivotable about the axis of the bore, externally accessible means for pivoting the cam, and a pair of substantially L-shaped pawls having respective base portions alternately engaged by the cam, the pawls further having respective leg portions extending forwardly of the cam for alternately engaging the ratchet means.

11. A ratcheting tool, comprising a driving handle means, a ratchet housing axially alined substantially with the handle means and mounted thereto, the ratchet housing having a blind axial bore formed therein, a driven shank having a portion nested at least partially in the bore, cooperating ratchet means and pawl means between the ratchet housing and the shank portion, externally-accessible cam means comprising a rotatable disc in the blind axial bore axially and rearwardly of the ratchet means and directly adjacent thereto, wherein the rotatable disc cam is wholly confined radially within the bore and is trapped axially between the bottom of the bore and the ratchet means, whereby the disc may be pivoted within the radial confines of the blind axial bore, means extending radially through the ratchet housing for pivoting the rotatable disc, thereby reversing the ratchet and pawl means, a spinner rotatably piloted on the ratchet housing, and means keying the spinner to the shank forwardly of the ratchet and pawl means.

12. A ratcheting tool, comprising a driving handle, a substantially cylindrical ratchet housing secured to the handle and extending forwardly therefrom, the ratchet housing having a blind axial bore formed therein, a driven shank having a rearward portion nested partially in the blind axial bore, a ratchet formed externally on the rearward portion of the shank, a cam comprising a substantially cylindrical member seated in the bottom of the blind axial bore axially and rearwardly of the ratchet and pivotable substantially about the axis of the bore, the cam having a bore formed therein, a thrust ball seated in the cam bore axially between the bottom of the bore in the ratchet housing and the rearward portion of the shank, thereby accommodating axial thrust loads on the tool, a selector pin carried by the cam and extending radially therefrom, a selector button carried by the selector pin radially of the ratchet housing, the ratchet housing having an arcuate slot formed therein to accommodate movement of the pin, a pair of substantially L-shaped pawls having respective base portions and further have respective leg portions extending forwardly of the cam and alternately engaging the ratchet, the cam having truncated faces bearing against the respective base portions of the pawls, the ratchet housing having a pair of internal recesses formed therein, one for each of the base portions of the pawls, whereby a respective pawl may be received in its recess as said pawl is selectively disengaged from the ratchet, resilient means between the respective pawls and recesses, three-position detent means between the cam and the ratchet housing, thereby establishing clockwise and counter-clockwise ratchet drive positions and an intermediate locked position, a knurled spinner piloted on the ratchet housing, and cooperating spline means between the spinner and an intermediate portion of the shank forwardly of the ratchet.

13. In a ratcheting tool, the combination of a ratchet housing having a blind axial bore and a communicating counterbore formed therein, a shank having an enlarged rearward portion received within the bore, a collar secured within the counterbore and abutting the enlarged rearward portion of the shank, thereby retaining the shank in the bore in the ratchet housing, a ratchet on the enlarged rearward portion of the shank, manually-manipulatable cam means comprising a rotatable disc in the bottom of the blind axial bore axially and rearwardly of the ratchet and directly adjacent thereto, wherein the disc cam is wholly confined radially within the bore and is trapped axially between the bottom of the bore and the ratchet on the enlarged rearward portion of the shank, reversible pawl means actuated by the rotatable disc and engaging the ratchet, wherein the pawl means are maintained in engagement with the ratchet without the necessity of a resilient bias being exerted on the disc cam, a spinner rotatably piloted on the ratchet housing, and means keying the spinner to the shank forwardly of the collar.

14. A ratchet adapter, comprising a ratchet housing having a blind axial bore formed therein, an input shank at one end of the ratchet housing and having a portion telescopically received within the bore, means for retaining the input shank against axial movement relative to the ratchet housing, a ratchet formed externally on the shank portion within the bore, a cam comprising a rotatable disc seated in the bottom of the blind axial bore axially and rearwardly of the ratchet and directly adjacent thereto, wherein the disc cam is wholly confined radially within the bore and is trapped axially between the bottom of the bore and the ratchet on the shank, the cam being pivotable about the axis of the bore, externally-accessible shift means carried by the ratchet housing, three-position detent means between the shift means and the ratchet housing, thereby establishing clockwise and counter-clockwise ratchet positions and an intermediate position, respectively, the shift means including a member extending radially of the axis of the bore and engaging the cam, reversible pawl means actuated by truncated chordal faces on the disc cam and extending axially therefrom to engage the ratchet in either the clockwise or counter-clockwise positions, respectively, thereby keying the ratchet to the ratchet housing and determining the drive direction, wherein the pawl means are maintained in engagement with the ratchet on the shank without the necessity of a resilient bias being exerted on the disc cam, an output shank at the other end of the ratchet housing, keying means between the output shank and the ratchet housing, and spinner means for rotating the ratchet housing in the clockwise or counter-clockwise positions, respectively.

15. In a ratcheting tool, the combination of a housing having an axial bore formed therein, a driven shank received within the bore, the shank having an enlarged portion formed with a ratchet, collar means within the bore adjacent to the ratchet for retaining the shank within the bore, a cam seated in the bore of the housing, the cam being trapped axially between the ratchet and the bottom of the bore, the cam being pivotable substantially about the axis of the bore, a pin carried by the cam and extending radially therefrom, the housing having an arcuate slot formed therein for receiving the pin, a selector carried on the end of the pin, a pair of pawls engaged by respective faces of the cam and having respective portions extending forwardly therefrom to engage the ratchet, the driven shank having a portion extending forwardly of the ratchet and retaining collar means, and a spinner having an inner substantially-cylindrical portion carried by the extending portion of the shank substantially adjacent to and forwardly of the collar means for rotation in unison with the shank, the spinner further having an outer substantially-cylindrical portion substantially concentric to the inner portion and spaced radially therefrom and rotatably surrounding the ratchet housing substantially adjacent to and forwardly of the selector, and wherein the retaining collar means is enclosed by the spinner.

* * * * *